US005769797A

United States Patent [19]

Van Brunt et al.

[11] Patent Number: 5,769,797

[45] Date of Patent: Jun. 23, 1998

[54] OSCILLATORY CHEST COMPRESSION DEVICE

[75] Inventors: Nicholas P. Van Brunt, White Bear Lake; Donald J. Gagne, St. Paul, both of Minn.

[73] Assignee: American Biosystems, Inc., St. Paul, Minn.

[21] Appl. No.: 661,931

[22] Filed: Jun. 11, 1996

[51] Int. Cl.[6] ..... A61H 31/00

[52] U.S. Cl. ..... 601/41; 601/44; 601/152

[58] Field of Search ..... 601/41–44, 48, 601/55, 56, 77, 148–152; 128/DIG. 20; 602/13

[56] References Cited

U.S. PATENT DOCUMENTS

| | | | |
|---|---|---|---|
| 2,354,397 | 7/1944 | Miller . | |
| 2,588,192 | 3/1952 | Akerman et al. . | |
| 2,626,601 | 1/1953 | Riley . | |
| 2,762,366 | 9/1956 | Huxley, III et al. . | |
| 2,772,673 | 12/1956 | Huxley, III . | |
| 2,779,329 | 1/1957 | Huxley et al. . | |
| 2,780,222 | 2/1957 | Polzin et al. . | |
| 2,818,853 | 1/1958 | Huxley, III et al. . | |
| 2,832,335 | 4/1958 | Huxley, III et al. . | |
| 2,869,537 | 1/1959 | Chu . | |
| 3,043,292 | 7/1962 | Mendelson . | |
| 3,063,444 | 11/1962 | Jobst | 601/150 |
| 3,120,228 | 2/1964 | Huxley, III . | |
| 3,310,050 | 3/1967 | Goldfarb . | |
| 3,333,581 | 8/1967 | Robinson et al. . | |
| 3,536,063 | 10/1970 | Werding | 601/152 |
| 3,566,862 | 3/1971 | Schuh et al. . | |
| 3,683,655 | 8/1972 | White et al. . | |
| 3,760,801 | 9/1973 | Borgeas . | |
| 3,802,417 | 4/1974 | Lang . | |
| 3,896,794 | 7/1975 | McGrath | 601/152 |
| 3,993,053 | 11/1976 | Grossan | 601/152 |
| 4,079,733 | 3/1978 | Denton et al. . | |
| 4,133,305 | 1/1979 | Steuer | 601/148 |
| 4,311,135 | 1/1982 | Brueckner et al. . | |
| 4,398,531 | 8/1983 | Havstad . | |
| 4,424,806 | 1/1984 | Newman et al. . | |
| 4,429,688 | 2/1984 | Duffy . | |
| 4,546,764 | 10/1985 | Gerber . | |
| 4,621,621 | 11/1986 | Marsalis . | |
| 4,676,232 | 6/1987 | Olsson et al. . | |
| 4,815,452 | 3/1989 | Hayek | 601/44 |
| 4,838,263 | 6/1989 | Warwick et al. . | |
| 4,928,674 | 5/1990 | Halperin et al. . | |
| 4,977,889 | 12/1990 | Budd | 601/44 |
| 4,982,735 | 1/1991 | Yagata et al. . | |
| 5,056,505 | 10/1991 | Warwick et al. . | |
| 5,076,259 | 12/1991 | Hayek . | |
| 5,101,808 | 4/1992 | Kobayashi et al. . | |
| 5,222,478 | 6/1993 | Scarberry et al. . | |
| 5,261,394 | 11/1993 | Mulligan et al. . | |
| 5,299,599 | 4/1994 | Farmer et al. . | |
| 5,453,081 | 9/1995 | Hansen | 601/149 |
| 5,606,754 | 3/1997 | Hand et al. | 601/149 |

FOREIGN PATENT DOCUMENTS

| | | | |
|---|---|---|---|
| 542383 | 5/1993 | European Pat. Off. | 601/152 |
| 1247-009-A | 7/1986 | U.S.S.R. . | |

OTHER PUBLICATIONS

Gross et al., "Peripheral Mucociliary Clearance With High–Frequency Chest Wall Compression", The American Physiological Society (1985).

Zidulka et al., "Ventilation by High–Frequency Chest Wall Compression in Dogs With Normal Lungs", Am. Rev. Respir. Dis., 127:709–713 (1983).

*Primary Examiner*—Jeanne M. Clark
*Attorney, Agent, or Firm*—David Edgeworth

[57] ABSTRACT

An oscillatory chest compression device includes an oscillatory air flow generator and a positive air flow generator. A first feedback system controls the oscillation rate of the oscillatory air flow generator, and a second feedback system controls the peak pressure created by the positive air flow generator.

15 Claims, 3 Drawing Sheets

OSCILLATORY CHEST COMPRESSION DEVICE

FIELD OF THE INVENTION

The present invention relates to an oscillatory chest compression device.

BACKGROUND OF THE INVENTION

Certain respiratory disorders, such as cystic fibrosis, emphysema, asthma, and chronic bronchitis, may cause mucous and other secretions to build up in a person's lungs. It is desirable, and sometimes essential, that the secretion build-up be substantially removed from the lungs to enable improved breathing. For example, Cystic fibrosis is an hereditary disease that affects the mucous secreting glands of a person, causing an excessive production of mucous. The mucous fills in the person's lungs and must be reduced daily to prevent infection and enable respiration by the person.

Currently there is no cure for cystic fibrosis. Current treatment of cystic fibrosis includes an aerosol therapy to assist lung drainage and repeated pounding on the upper torso of the person to loosen and expel the mucous. This daily treatment may take several hours and requires a trained individual to apply the pounding treatment.

Pneumatic and mechanical systems have been developed for loosening and removing secretions from a person's lungs. In one pneumatic system, a bladder is positioned around the upper torso of the patient. One or more hoses connect the bladder with a mechanism for generating air pulses in the bladder. The pulsing of the bladder provides chest compressions to the patient. The pulsing frequency is independent of and higher than the patient's breathing rate. One such system, disclosed in U.S. Pat. No. 4,838,263, is a valve-operated, open-loop system that requires the patient to interact with the system throughout the treatment period.

Other systems include mechanical vibrators. Some vibrator systems are attached to the person's torso, while others are hand-held. Vibrators and other direct mechanical compression devices are likely to be heavier than pneumatic compression devices.

A chest compression device, as is the case with medical devices generally, must meet a variety of requirements. First, the chest compression device must be safe to operate. The patient receiving treatment should not be able to adjust the device to create unsafe treatment conditions. Failure of device components must not create unsafe conditions. The chest compression device should provide some user control, allowing the device to be customized to the needs of individual users. The device should be easy to understand and operate by the user; detailed training and complicated controls increase the cost of the treatment. Finally, the device should minimize intrusion into the daily activities of the user.

SUMMARY OF THE INVENTION

The present invention is directed to an oscillatory chest compression device that loosens and assists in expulsion of secretions in a person's lungs. A vest, containing a bladder, is secured to a patient's upper torso. One or more tubes connect the bladder with a generator. The generator includes a first, oscillatory air flow generator. A second, positive air flow generator is operably connected with the oscillatory air flow generator. Feedback systems control both the oscillatory air flow generator and the positive air flow generator, providing treatment at user-selected parameters and preventing unsafe conditions.

The inventors of the present invention were the first to recognize several design aspects that result in an efficacious, safe, and easy-to-use oscillatory chest compression device. The oscillatory air flow generator includes a reciprocating diaphragm. The reciprocating diaphragm delivers a generally constant pressure throughout the range of oscillation frequencies, providing efficacious treatment throughout the range of user-selectable frequency settings. The reciprocating diaphragm provides a more efficient transfer of electrical energy to pneumatic energy as compared to prior rotary-valve designs.

One major safety concern in a pneumatic chest compression device is over-pressurization of the bladder. The reciprocating diaphragm provides inherently safe pressure conditions. The only way a reciprocating diaphragm can increase pressure in the bladder is to increase the diaphragm stroke length or diameter. However, there is no failure mode that will increase the stroke length or diameter of the reciprocating diaphragm.

The present invention includes a positive air flow generator operably connected with the oscillatory air flow generator. The positive air flow generator compensates for any leakage in the system, including the hoses and bladder. Also, the positive air flow generator, in connection with a feedback system, maintains the desired peak pressure delivered by the bladder, independent of variations in the bladder and the patient. The positive air flow generator includes the safety feature of a fuse connected with the input power. The fuse is rated so as to prevent a power surge from causing the positive air flow generator to generate an unsafe, high pressure.

The oscillatory chest compression device of the present invention is automated, allowing the user to select operating parameters for a treatment and then direct his attention to other matters. The feedback systems of the present invention maintain the user-selected parameters during the treatment. The user controls are selected so that the user cannot select operating parameters that would result in unsafe chest compression treatment.

Other advantages and features will become apparent from the following description and claims.

BRIEF DESCRIPTION OF THE DRAWINGS

These and other aspects of the present invention will be described in detail with respect to the accompanying drawings, in which.

DETAILED DESCRIPTION OF THE EMBODIMENTS

Figure 1:
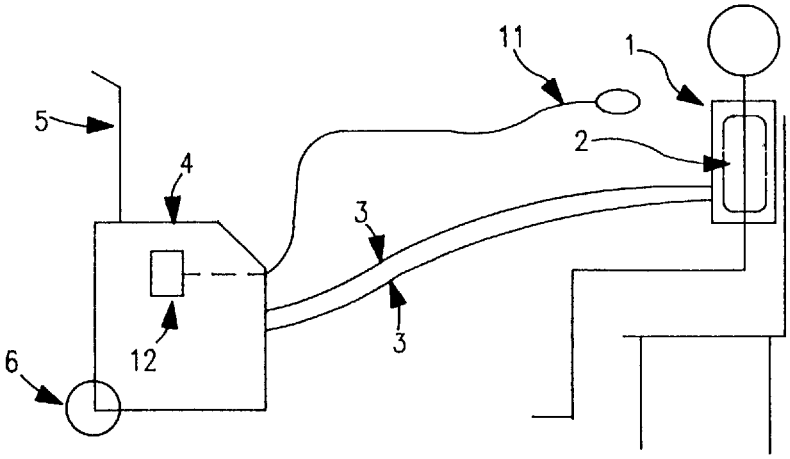
FIG. 1 is an illustration of a person and a chest compression device.

A chest compression device is shown in FIG. 1. A vest 1 is secured about the torso of a patient. A bladder 2 is fitted within vest 1. Oscillatory air pulses are delivered to bladder 2. The outer surface of vest 1 is made of a non-stretch material, causing the expansions and contractions of bladder 2 to occur generally adjacent the patient's torso. The expansions and contractions create a pneumatic, oscillatory compression of the patient's torso to loosen and assist the expulsion of mucous and other secretions in the patient's lungs. Suitable vests are available from American Biosystems, Inc., St. Paul, Minn., the assignee of the present invention.

Figure 3:
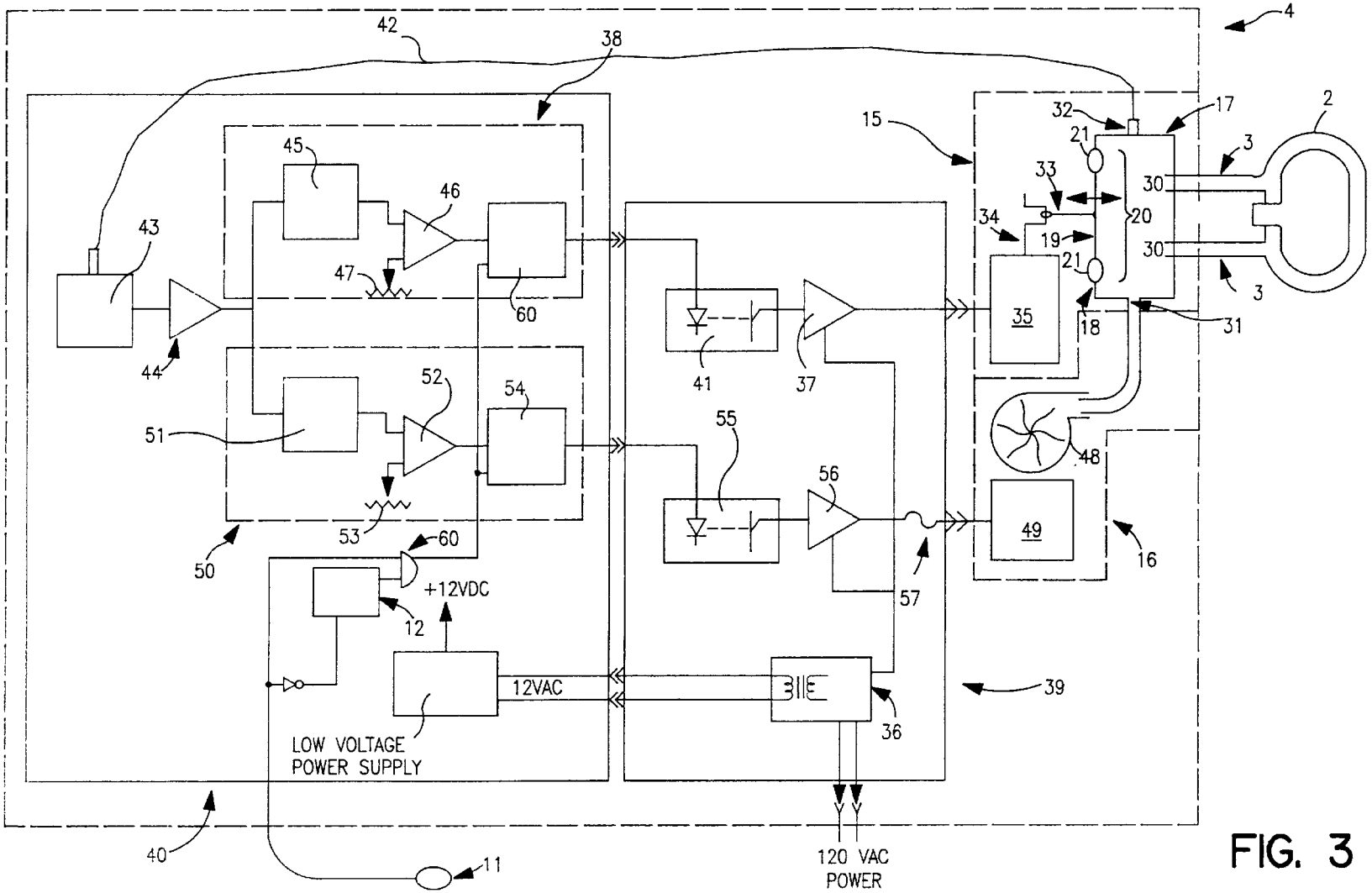
FIG. 3 is a schematic diagram of a chest compression device.

Tubes 3 connect bladder 2 with generator 4. Two tubes 3 are shown in FIGS. 1 and 3; however, the number of tubes 3 may be varied depending on the desired operating parameters of bladder 2. Generator 4 generates oscillatory air pulses in accordance with user-selected settings. The pulses are converted into compressions of the patient's torso by bladder 2. Generator 4 may be configured as a mobile unit with handle 5 and wheels 6, or as a stationary unit.

Figure 2:
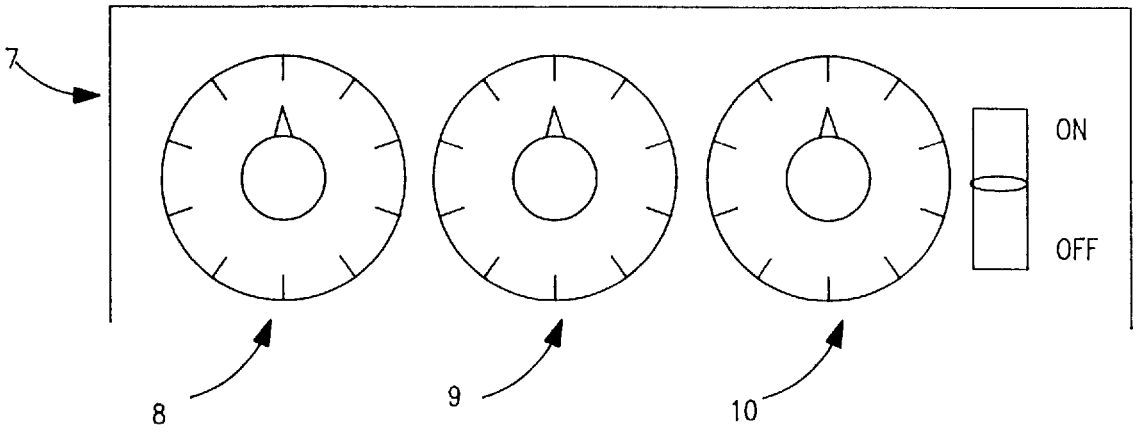
FIG. 2 is a schematic diagram of the control panel of a chest compression device.

Generator 4 includes a control panel 7, shown in FIG. 2. Timer 8 allows the user to select a treatment period. Frequency selector 9 allows the user to select the frequency of compressions. In one embodiment, the frequency range is about five to twenty-five Hz. Pressure selector 10 allows the user to select the peak pressure for each oscillation. In one embodiment, the pressure range is about 0.2 to 0.6 PSI.

As shown in FIG. 1, the user typically is seated during treatment. However, the user has some local mobility about generator 4, determined by the length of hoses 3. Also, the mobile unit shown in FIG. 1 may be easily transferred to different locations. For treatment, the user selects the desired operating parameters and no further interaction by the user is required; generator 4 maintains the user-selected parameters. The user may change the settings at any time. A remotely-operated control 11 allows the user to start and stop the treatment.

Generator 4 also includes a ten-minute safety timer 12. Once the user initiates treatment, safety timer 12 starts. Safety timer 12 is reset each time the user activates start/stop control 11. If the safety timer expires, generator 4 is turned off. Therefore, even if the user loses consciousness or is otherwise incapacitated, generator 4 is turned off after a predetermined period, reducing the likelihood of injury to the user due to an excessive period of chest compressions.

A block diagram of generator 4 is shown in FIG. 3. Generator 4 includes two air flow units, oscillatory air flow generator 15 and positive air flow generator 16. Oscillatory air pulses are generated by oscillatory air flow generator 15. Oscillatory air flow generator 15 includes an air chamber 17. Air chamber 17 includes a wall 18 having a reciprocating diaphragm 19 suspended in an aperture 20 of wall 18 by a seal 21.

Figure 4:
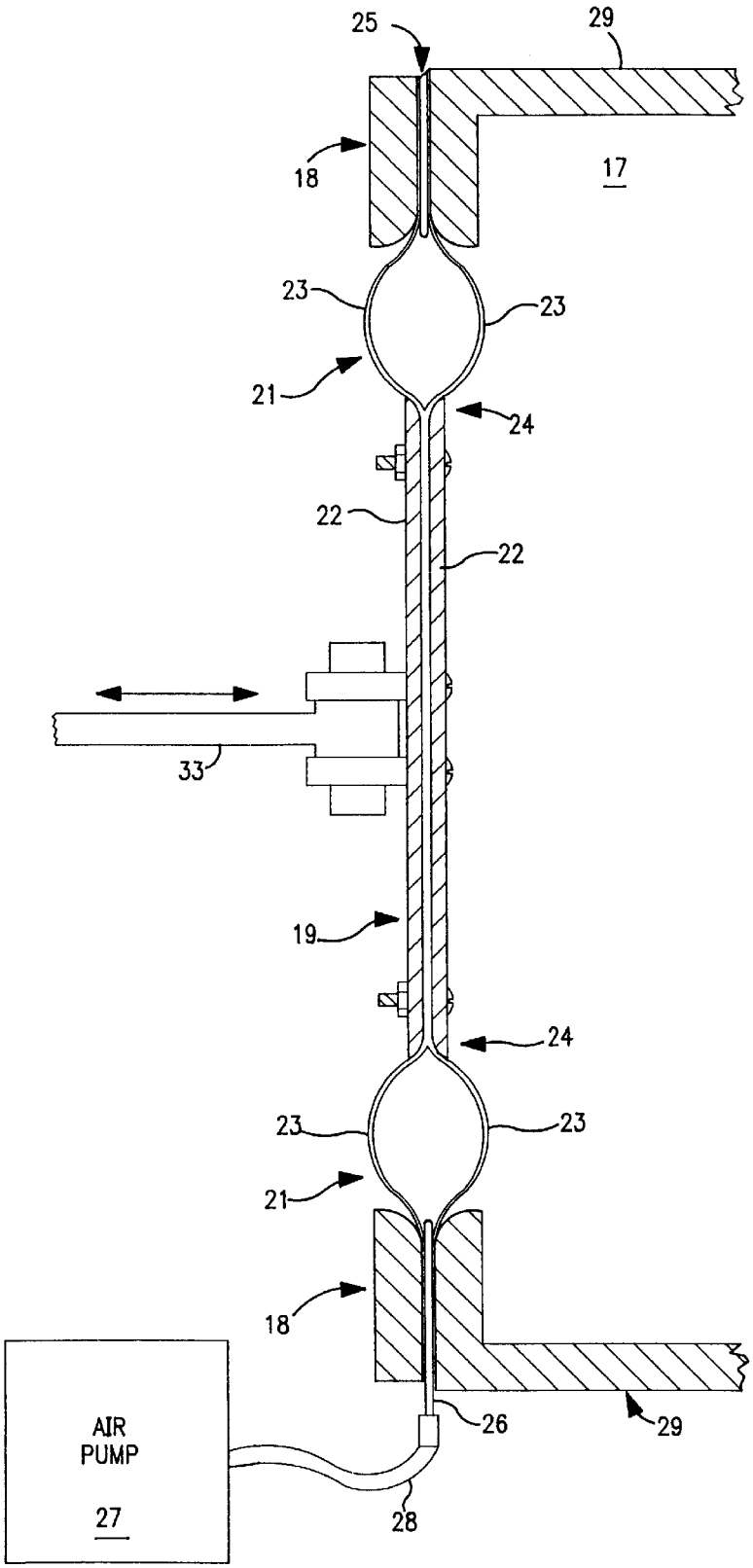
FIG. 4 is a schematic diagram of a portion of a chest compression device.

As shown in FIG. 4, diaphragm 19 is a generally rigid disk assembly of two opposed, generally circular disks 22. Flexible, air-tight seal 21 is formed by two rubber disks 23 positioned between diaphragm disks 22. Diaphragm disks 22 are clamped together by bolts or other fastening means. Rubber disks 23 extend from the outer periphery 24 of diaphragm disks 22 into a groove 25 in wall 18, thereby forming a generally air-tight seal in the gap between diaphragm 19 and wall 18.

Air pressure is supplied to seal 21 by capillary tube 26, which is supplied by air pump 27 and tubing 28. Air pump 27 maintains the air pressure in seal 21 higher than the maximum pressure peaks in air chamber 17. In one embodiment, the air pressure in seal 21 is maintained at about 1.5 PSI. The pressure relationship causes rubber disks 23 to maintain the inflated shape as shown in FIG. 4 as diaphragm 19 reciprocates. This results in a smooth, quiet, low-friction travel of diaphragm 19, while maintaining an air-tight seal between diaphragm 19 and wall 18.

The remaining walls 29 of air chamber 17 are generally rigid. Apertures 30 provide fluid communication between air chamber 17 and tubes 3. Aperture 31 provides fluid communication with positive air flow generator 16. Aperture 32 provides fluid communication with the control system described below.

Diaphragm 19 is mechanically connected through rod 33 to a crankshaft 34, which is driven by motor 35. Each rotation of crankshaft 34 causes a fixed volume of air (defined by the area of the diaphragm multiplied by the length of the stroke) to be displaced in air chamber 17. The pressure changes inside air chamber 17 resulting from the displacements are relatively small (e.g., less than one PSI) in comparison to the ambient air pressure. Therefore, there is little compression of the air in air chamber 17 and the majority of the displaced air is moved into and out of bladder 2 through tubes 3 during each cycle. This results in the amount of air transferred into and out of bladder 2 during each cycle being largely independent of other factors, such as the oscillation frequency and bladder size.

In one embodiment, motor 35 is a permanent magnet DC brush motor. The motor speed is generally controlled by the voltage supplied to it. A 170 volt DC power supply 36 energizes power amplifier 37. Power amplifier 37 is controlled by a frequency-compensation feedback circuit 38, thereby supplying variable length pulses to motor 35. The inductance of motor 35 effectively smoothes the pulses to a constant power level that is proportional to the ratio of the pulse length divided by the pulse period. Using a pulse period of 20 kHz, the pulse length controls the motor speed.

As shown in FIG. 3, all of the power circuitry is located on power board 39. The control circuitry is located on a separate, low-energy control board 40. The control board 40 is connected to the power board 39 by 5000-volt opto-isolators 41, 55. The high level of isolation between the power board 39 and control board 40 provides significant shock protection for the user.

Conduit 42 conveys changes in pressure from air chamber 17 to pressure transducer 43. Pressure transducer 43 converts the air pressure into an oscillating electronic signal, which is then amplified by amplifier 44. The output of amplifier 44 is then processed by frequency-compensation feedback circuit 38.

Frequency-to-voltage converter 45 converts the oscillating signal to a voltage level proportional to the frequency. The output of converter 45 is fed to difference amplifier 46. Difference amplifier 46 has a second input 47 representing the user-selected frequency setting. Difference amplifier 46 compares the voltage representing the user-selected frequency with the voltage representing the actual frequency detected in air chamber 17. The output of difference amplifier 46 is input into pulse-width modulator 60. The output of pulse-width modulator 60 is fed through opto-isolator 41 and power amplifier 37 to motor 35, thereby adjusting the speed of motor 35 and, consequently, the oscillation frequency in air chamber 17.

Reciprocating diaphragm 19 of oscillatory air flow generator 15 provides several advantages. First, the amount of air transferred into and out of bladder 2 during each cycle is largely independent of the oscillation frequency setting. In prior art systems, using a constant air flow and valve configuration, less air flow was delivered at higher frequencies. Therefore, the present invention provides a more consistent air flow over the user selectable frequency range. This consistency provides a more efficacious treatment.

Further, reciprocating diaphragm 19 is both efficient and safe. The substantially closed-loop reciprocating diaphragm configuration provides a more efficient transfer of electrical energy to pneumatic energy as compared to prior art valve designs. Also, the reciprocating diaphragm provides inherently safe air flow.

One of the main safety concerns with bladder-type chest compression systems is over-inflation of the bladder. In a reciprocating diaphragm system, there is no net increase in pressure, i.e., the air flow on the in-stroke equals the air flow on the out-stroke. The only way to increase air flow is to increase the diaphragm stroke length or the surface area of the diaphragm. In the present invention, there is no failure mode that could cause either an increased stroke length or increased diaphragm surface area. Conversely, in valve-operated pneumatic devices, a malfunction of a valve may cause unsafe pressures to develop in bladder 2.

Frequency-compensation feedback system 38 serves to maintain the oscillation frequency at the user-selected value. Also, frequency selector 9 is calibrated so that oscillatory air flow generator 15 operates at a maximum oscillation rate as the default value, and frequency selector 9 can only decrease the oscillation frequency. The maximum default oscillation rate is selected to be within safe parameters, therefore, the user cannot increase the oscillation rate to an unsafe level.

Although diaphragm 19 approximates a perfect system in terms of displacement of air into and out of bladder 2 on each stroke, remaining parts of the closed system are less perfect. For example, bladder 2 typically leaks air at a variable rate that is difficult to model. The amount of air leakage is influenced by many factors, including variations in production of the bladder, age, use, and other factors.

Also, tubes 3 and the various connections within the system may also leak. Additionally, the air pressure delivered to bladder 2 must be varied due to the repeated inhalation and expiration of the user during treatment, and also due to the size of the particular user. Therefore, positive air pressure generator 16 is used to supply positive air pressure to the system to compensate for the above-identified variables.

Positive air flow generator 16 includes a blower 48 driven by motor 49. The speed of motor 49 is controlled by pressure-compensation feedback system 50, thereby controlling the output pressure of blower 48.

As shown in FIG. 3, pressure-compensation feedback system 50 is similar to frequency-compensation feedback system 38. The output of pressure transducer 43 is fed through amplifier 44 to a pressure peak detector 51. Peak detector 51 captures the pressure waveform peaks within air chamber 17 and generates a voltage proportional to the pressure peak. This voltage is fed to difference amplifier 52.

Difference amplifier 52 includes a second input 53 representing the user-selected pressure. The difference in actual peak pressure and selected peak pressure is represented in the voltage output of difference amplifier 52 and is fed to pulse-width modulator 54. The output of pulse-width modulator 54 is fed through a second opto-isolator 55 and a second power amplifier 56 on power board 39 to motor 49. Motor 49 drives blower 48 to maintain the peak pressure in air chamber 17 at the user-selected value.

One of ordinary skill in the art will recognize that the pressure in air chamber 17 may also be decreased by a flow of air from air chamber 17 into blower 48, depending on the pressure in air chamber 17 compared to the pressure created by blower 48. In one embodiment, blower 48 may be reversible.

Positive air flow generator 16 and pressure-compensation feedback system 50 provide several advantages. First, positive air flow generator 16 dynamically adjusts the peak pressure in air chamber 17 to provide a consistent peak pressure based on the user selected peak pressure, independent of leaks in the system, size of the user, condition of the bladder, and the repeated inhalation and expiration of the user. Maintaining a constant peak pressure provides for increased efficacy of treatment.

Also, the user only has to make an initial pressure selection, no further interaction with generator 4 is required. The maximum peak pressure setting is selected to be within a safe treatment range. As an additional safety feature, fuse 57 serves to prevent a power surge in power supply 36 from causing blower 48 to inflate bladder 2 to an unsafe pressure.

The circuit for user-operated start/stop control 11 and safety timer 12 are also shown in FIG. 3. In one embodiment, control 11 is a pneumatic switch of known construction. In other embodiments, control 11 may be electronic or electro-mechanical. Actuation of control 11 serves to reset safety timer 12 and also control pulse width modulators 60, 54. The AND gate 60 requires that safety timer 12 be active (i.e., not zero) and control 11 be ON in order for generator 4 to create air pulses.

It is important to note the general ease-of-use provided by the present invention. To initiate treatment, the user simply puts on vest 2 and selects operating parameters on control panel 7, very little training is required. This helps keep down the total cost of the treatment. Also, the user is not required to constantly interact with the device during treatment.

Other embodiments are within the scope of the following claims.

What is claimed is:

1. An apparatus for generating oscillatory air pulses in a bladder positioned about a person, comprising:

an oscillatory air flow generator, comprising an air chamber;

a reciprocating diaphragm operably connected with the air chamber;

a rod having a first end and a second end, the first end operably connected with the diaphragm, and the rod extending generally orthogonal to the diaphragm;

a crankshaft operably connected with the second end of the rod and extending generally orthogonal to the rod; and a first motor operably connected with the crankshaft;

a positive air flow generator operably connected with the oscillatory air flow generator;

control means operably connected with the oscillatory air flow generator and operably connected with the positive air flow generator for controlling the peak pressure generated by the positive air flow generator; and a seal extending from an outer periphery of the diaphragm to a wall of the air chamber, the seal comprising first and second generally opposed disks defining an annular region for receiving air, and a pump operably connected with the annular region, the pump maintaining the air pressure in the annular region greater than the peak pressure generated in the air chamber.

2. The apparatus of claim 1 further comprising means for connecting the oscillatory air flow generator with a bladder.

3. The apparatus of claim 1, wherein the control means comprises a first feedback circuit for causing the oscillatory air flow generator to generate air pulses at a predetermined frequency.

4. The apparatus of claim 3 wherein the first feedback circuit comprises:

means for detecting the oscillation rate in the air chamber;

means for comparing the detected oscillation rate with a predetermined rate; and means for adjusting the oscillatory air flow generator so that the detected oscillation rate approximately equals the predetermined rate.

5. The apparatus of claim 3 further comprising a frequency selector, allowing a user to select the predetermined frequency.

6. The apparatus of claim 1 wherein the positive air flow generator comprises a blower, and a second motor operably connected with the blower.

7. The apparatus of claim 6, wherein the control means further comprises a second feedback circuit for causing the positive air flow generator to maintain a predetermined peak pressure in the oscillatory air pulses.

8. The apparatus of claim 7 wherein the second feedback circuit comprises:

means for detecting the peak pressure in the air chamber;

means for comparing the detected peak pressure with a predetermined value; and means for adjusting the positive air flow generator so that the detected peak pressure equals the predetermined value.

9. The apparatus of claim 7 further comprising a pressure selector, allowing a user to select the predetermined peak pressure.

10. The apparatus of claim 6 further comprising means connected to the second motor for preventing the second motor from operating the blower above a predetermined pressure.

11. The apparatus of claim 10 wherein the means for preventing comprises a fuse.

12. The apparatus of claim 1, further comprising a remote start/stop control operably connected with the control means.

13. The apparatus of claim 12 further comprises a timer operably connected with the remote start/stop control.

14. The apparatus of claim 1, wherein the first motor operates at a speed sufficient to maintain the minimum frequency of the oscillatory air flow generator at about five hertz.

15. The apparatus of claim 1, wherein the first motor rotates continuously during operation of the apparatus.

* * * * *